US007600868B2

(12) United States Patent
Koga et al.

(10) Patent No.: US 7,600,868 B2
(45) Date of Patent: Oct. 13, 2009

(54) RECORDING PAPER AND IMAGE RECORDING METHOD THEREOF

(75) Inventors: Chizuru Koga, Ebina (JP); Kiyoshi Hosoi, Ebina (JP); Takashi Ogino, Ebina (JP); Tsukasa Matsuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 567 days.

(21) Appl. No.: 11/020,268

(22) Filed: Dec. 27, 2004

(65) Prior Publication Data

US 2005/0244593 A1 Nov. 3, 2005

(30) Foreign Application Priority Data

Apr. 28, 2004 (JP) ..... 2004-133514

(51) Int. Cl.
*B41M 5/50* (2006.01)

(52) U.S. Cl. ..... 347/105; 428/32.31; 428/195.1; 430/48

(58) Field of Classification Search ..... None
See application file for complete search history.

(56) References Cited

U.S. PATENT DOCUMENTS

| | | | |
|---|---|---|---|
| 4,325,735 | A | 4/1982 | Ohta et al. |
| 5,142,327 | A | 8/1992 | Kahle |
| 5,190,563 | A | 3/1993 | Herron et al. |
| 5,302,439 | A | 4/1994 | Malhotra et al. |
| 5,441,795 | A | 8/1995 | Malhotra et al. |
| 5,451,458 | A | 9/1995 | Malhotra |
| 5,451,466 | A | 9/1995 | Malhotra |
| 5,457,486 | A | 10/1995 | Malhotra et al. |
| 5,541,002 | A | 7/1996 | Hosoi et al. |
| 5,589,277 | A | 12/1996 | Malhotra |
| 5,657,064 | A | 8/1997 | Malhotra |
| 5,659,348 | A | 8/1997 | Malhotra |
| 5,663,022 | A | 9/1997 | Malhotra |
| 5,757,408 | A | 5/1998 | Malhotra |
| 5,882,390 | A | 3/1999 | Nagai et al. |
| 5,882,754 | A | 3/1999 | Kuroyama et al. |
| 5,922,910 | A | 7/1999 | Labat et al. |
| 5,928,765 | A | 7/1999 | Malhotra |
| 6,117,527 | A | 9/2000 | Schwarz, Jr. |
| 6,221,198 | B1 | 4/2001 | Gryska et al. |
| 6,383,612 | B1 | 5/2002 | Waller, Jr. et al. |
| 6,482,503 | B1 | 11/2002 | Malhotra |
| 6,537,650 | B1 | 3/2003 | Waller, Jr. et al. |
| 6,786,586 | B2 | 9/2004 | Koga et al. |
| 6,800,429 | B2 | 10/2004 | Lelental et al. |
| 6,846,525 | B2 | 1/2005 | Malhotra |
| 7,105,214 | B2 | 9/2006 | Malhotra |
| 7,510,750 | B2 | 3/2009 | Koga et al. |
| 2003/0048344 | A1 | 3/2003 | Koga et al. |
| 2003/0141487 | A1 | 7/2003 | Lelental et al. |
| 2003/0179566 | A1 | 9/2003 | Ito |
| 2003/0188838 | A1 | 10/2003 | Yancey et al. |
| 2003/0192659 | A1 | 10/2003 | Yancey et al. |
| 2003/0227531 | A1 | 12/2003 | Hosoi et al. |
| 2003/0234846 | A1 | 12/2003 | Koga et al. |
| 2004/0035323 | A1 | 2/2004 | Suzuki et al. |
| 2004/0121093 | A1 | 6/2004 | Ogino et al. |
| 2005/0244592 | A1 | 11/2005 | Koga et al. |

FOREIGN PATENT DOCUMENTS

| | | | |
|---|---|---|---|
| CN | 1352599 | | 6/2002 |
| JP | A 61-74880 | | 4/1986 |
| JP | A 7-257017 | | 10/1995 |
| JP | A 8-216498 | | 8/1996 |
| JP | 8-244335 | | 9/1996 |
| JP | A 9-176995 | | 7/1997 |
| JP | A-9-290556 | | 11/1997 |
| JP | A-10-86527 | | 4/1998 |
| JP | A 10-100531 | | 4/1998 |
| JP | A 10-166713 | | 6/1998 |
| JP | 10-305656 | A | 11/1998 |
| JP | 11-174718 | A | 7/1999 |
| JP | 2001-054976 | A | 2/2001 |
| JP | 2001-147545 | A | 5/2001 |
| JP | A 2002-96547 | | 4/2002 |
| JP | A-2002-144719 | | 5/2002 |
| JP | A-2002-154270 | | 5/2002 |
| JP | A-2002-166644 | | 6/2002 |
| JP | A-2002-172851 | | 6/2002 |
| JP | 2003-003093 | A | 1/2003 |
| JP | A-2003-011492 | | 1/2003 |
| JP | 2003-072230 | A | 3/2003 |
| JP | A-2003-191607 | | 7/2003 |
| JP | A-2003-326844 | | 11/2003 |
| JP | A-2004-114627 | | 4/2004 |
| WO | WO 99/06219 | | 2/1999 |
| WO | WO 00/44568 | | 8/2000 |

*Primary Examiner*—Bruce H Hess
(74) *Attorney, Agent, or Firm*—Oliff & Berridge, Plc

(57) ABSTRACT

The present invention provides a recording paper comprising pulp fibers and filler as main components and containing at least a cationic substance and a water-soluble polymer in a surface of the recording paper, wherein conductivity of water is not less than 0.002 S/m as measured at 1 second after immersing a piece of the recording paper with an area of 0.05 $m^2$ in 40 ml of pure water.

14 Claims, No Drawings

RECORDING PAPER AND IMAGE RECORDING METHOD THEREOF

CROSS-REFERENCE TO RELATED APPLICATION

This application claims priority under 35 USC 119 from Japanese Patent Application No. 2004-133514, the disclosure of which is incorporated by reference herein.

BACKGROUND OF THE INVENTION

1. Field of the Invention

The present invention relates to a recording paper and an image recording method thereof. In particular, the invention relates to a recording paper using so-called plain paper having no coated layer containing substantial quantity of pigment on either surface thereof, and a image recording method for ink-jet printing and electrophotographic printing using the same.

2. Description of the Related Art

An image forming machine using an ink-jet printing method has characteristics such as: ease of coloring; low energy consumption; low noise generation during recording; and the ability to suppress production costs to low levels. Due to such advantages, image forming machines using ink-let printing methods have become widely used in offices in recent years, with increases in the number of machines which use ink-jet printing methods combined with electrophotographic image recording machines such as laser printers and copy machines.

Recording media (recording paper) such as so-called plain paper, coated paper and glossy paper for ink-jet printing, white film, and transparent film are used in image forming with ink-jet printing methods. Particularly when an image forming machine using ink-jet printing method is employed in an image forming machine of an electrophotographic printing method, such as a laser printer or copier in an office or the like, printing is conducted most often on plain paper. Among these machines most use plain paper, on which an image can be formed easily, which is readily available and at a low cost.

Therefore, enhancing the suitability for recording of plain paper image forming with ink-jet printing method is extremely important. However, there have been the following problems when printing is conducted on plain paper in conventional image forming with ink-jet printing methods.

(1) A so-called feathering phenomenon occurs whereby ink flows out along fibers in plain paper. Feathering significantly deteriorates image quality, particularly the quality of printed characters/letters.

(2) So-called plain paper usually contains a sizing agent on the surface for making the surface water-repellent. Consequently, absorption of ink is delayed, causing so-called inter-color bleeding (ICB) at portions where different colors contact with each other.

(3) Since absorption of the ink is delayed due to the water repelling properties of plain paper surfaces, faces which contact with printed surface become dirty when printed documents are stacked.

(4) Since colorants in the ink hardly stay on the surface of plain paper, the coloring nature of color ink is inadequate.

(5) Since the colorants in inks permeate into plain paper, printed images can be seen through from the back of plain paper—rendering double-sided printing impossible.

Ink-jet printers have attempted to produce high printing speeds comparable to that of laser printers, in accordance an expanded market for ink-jet printers in the office. However it has been very difficult to attain permeability (dryability) and image quality whilst also the ability to carry out double-sided printing.

To address these problems, Japanese Patent Applications Laid-Open (JP-A) Nos. 10-166713, 7-257017, 8-216498, 10-100531, 9-176995 and 2002-96547 have proposed methods for improving image quality by enhancing aggregation/precipitation of ink components using printing papers subjected to a surface treatment with cationic substances such as cationic polymers and polyvalent metal salts.

Of these methods, a method of adding a substance in advance to inks that increases the viscosity of the ink by reacting with a cationic substance applied to a surface of the printing paper is particularly useful for improving image quality. This is because non-uniform spread out rates of colorants contained in ink, when ink is applied to paper having the cationic substance on the surface can be controlled when high viscosity is obtained.

However, improved permeability (dryability) of the printing paper to the ink is the problem of the highest priority for ink-jet printers if a high printing speed comparable to that of the laser printer is desired. Accordingly, the recording printing paper used for the ink-jet printer compatible of such high speed printing is required to have the following characteristic. It is required to both accelerate permeation of the ink into the printing paper and also make ink components aggregate/precipitate within the very short period of time, after the ink has been printed on the surface of paper before the ink completes permeation into the printing paper.

Improvement of ink permeability (dryability) has been investigated by focussing on the processes of insolubilization/aggregation/precipitation of ink applied on a surface of printing paper. For example, regulation by using the quantity of ions eluted by cold water extraction for the printing paper has been proposed (JP-A Nos. 10-100532 and 61-74880).

For improving permeability (dryability) of the printing paper to ink focuss has been made on the processes of insolubilization/aggregation/precipitation of ink components printed on the surface of the printing paper. However, it has been difficult to comply with the required high speed permeability (dryability) of the ink, necessary for high speed printing, by using printing paper provided to conventional evaluation criteria for insolubilization/aggregation processes such as cold water extraction.

A printing paper used for ink-jet printing is required to have high ink permeability (dryability) that is compatible with high speed printing. In addition, generally it is becoming increasingly common that offices are equipped with both ink-jet printers and electrophotographic copy machines, used in the same office. Accordingly, a printing paper is required which is applicable to imaging by ink-jet printing as well as being sufficiently suitable to imaging using of electrophotographic methods.

SUMMARY OF THE INVENTION

The present invention has been made in view of the above circumstance and provides a recording paper and an image recording method using the recording paper. That is, the invention provide a recording paper which can be jointly used for both ink-jet printing methods and electrophotographic printing methods. In ink-jet printing methods, the recording paper is: applicable to high-speed printing, regardless of the type of the colorants; provides fast ink drying; provides high image density in the obtained images; gives little feathering and inter-color bleeding; and gives a low density of see-through. In electrophotographic printing methods, the change of electric resistivity of the recording paper due to the environment is small and it provides excellent transferability. And the invention provide an image recording method using such a recording paper.

The inventors of the invention have made intensive studies, to address the above-mentioned problems. Specifically studied is whether the conventional evaluation method using cold water extraction is proper or not as an evaluation method of insolubilization/aggregation/precipitation processes of ink components applied onto a surface of a recording paper.

The inventors of the invention have concluded, as a result of the above investigations, that the cold water extraction method is not valid as a method for accurately evaluating the processes of insolubilization/aggregation/precipitation of ink components after application onto a surface of recording paper. This is because the time required for extraction with cold water is much longer when compared with the time required for eluting cationic substances from a surface of a recording paper into the ink, when the ink is printed onto a surface of the recording paper in ink-jet printing.

In particular, the time required for completing ink permeation into the recording paper, after printing the ink on the surface of the recording paper, is quite short in high speed printing.

Since the amount of cationic substance performing ion dissociation within the short period of time described above is not correlated with the amount of ions in cold water extraction, even if recording paper provided to the evaluation method using cold water extraction is used and improvement of image quality during high speed printing may not be attained. This means that using the conventional evaluation method of insolubilization/aggregation processes it is difficult to obtain a recording paper which provides excellent ink permeability (dryability).

This implies that it is impossible to improve the image quality by suppressing inter-color bleeding and feathering in ink-jet printing even, by using a cationic substance having a high cation equivalent or a large quantity of cationic substance for treating the surface of the recording paper, unless the cationic substance present on the surface of the recording paper is promptly dissociated and dissolved in the ink after applying the ink onto the surface of the recording paper.

Even supposing that the effectiveness of a cationic substance did not depend on the ion dissociation rate and that inter-color bleeding and feathering could be suppressed by using a recording paper subjected to surface treatment with a large quantity of cationic substance, in this case the electric resistance of the recording paper would be liable to be readily changed by variations of the environment. Accordingly, depending on the environment of use, such recording paper causes deterioration of the transferability by electrophotographic recording and consequently makes it impossible to obtain high adaptability for both electrophotography and ink-jet printing.

The inventors of the invention provide the following based on the above knowledge and findings.

A first aspect of the invention is to provide a recording paper containing pulp fibers and filler as main components and containing in a surface of the recording paper at least a cationic substance and a water-soluble polymer, wherein a conductivity of water is not less than 0.002 S/m as measured at 1 second after immersing a piece of the recording paper with an area of 0.05 $m^2$ in 40 ml of pure water.

A second aspect of the invention is to provide an ink-jet image recording method for forming an image by applying onto a surface of a recording paper a droplet of ink containing a colorant and at least one solvent selected from the group consisting of water and a water-soluble organic solvent. The recording paper contains pulp fibers and filler as main components with at least a cationic substance and a water-soluble polymer on the surface thereof, and a conductivity of water is not less than 0.002 S/m as measured at 1 second after immersing a piece of the recording paper with an area of 0.05 $m^2$ in 40 ml of pure water.

In a third aspect of the invention is to provide an electrophotographic image recording method including: uniformly charging a surface of an electrostatic latent image support; exposing the surface of the electrostatic latent image support to light, to thereby form an electrostatic latent image; developing the electrostatic latent image formed on the surface of the electrostatic latent image support, using an electrostatic image developer, to form a toner image; transferring the toner image onto a surface of a recording paper; and fixing the toner image transferred onto the surface of the recording paper. The recording paper contains pulp fibers and filler as main components with at least a cationic substance and a water-soluble polymer on the surface thereof, and a conductivity of water is not less than 0.002 S/m as measured at 1 second after immersing a piece of the recording paper with an area of 0.05 $m^2$ in 40 ml of pure water.

DETAILED DESCRIPTION OF THE INVENTION

Recording Paper

The recording paper of the present invention contains pulp fibers and filler as main components and contains in a surface of the recording paper at least a cationic substance and water-soluble polymer, wherein a conductivity of water is not less than 0.002 S/m as measured at 1 second after immersing a piece of the recording paper with an area of 0.05 $m^2$ in 40 ml of pure water.

In particular, the recording paper according to the invention is preferably produced by applying onto a surface of a base paper, that contains pulp fibers and filler as the main components, a treatment solution containing at least a cationic substance and a water-soluble polymer.

Coated paper, having a coated layer containing pigment on a surface of a recording paper as used as electrophotographic and ink-jet printing papers in offices, involves a cost disadvantage and may cause scratches to conveying elements and generate paper dust. Therefore it is particularly preferable that the recording paper of the invention is so-called "plain paper" having no coated layer containing substantial quantity of pigment on either surface thereof. For producing such a paper, the surface is treated with a treatment solution containing no substantial quantity of pigment (with a pigment content of not higher than 20% by weight).

The recording paper of the invention provides: a high density image; little inter-color bleeding and feathering; the capability to form an image with low see-through density, irrespective of the type of the colorant used in the ink, even when the paper is printed at high speed using a highly permeable ink.

In order to obtain these effects, a conductivity of water is required to be less than 0.002 S/m as measured at 1 second after immersing a piece of the recording paper with an area of 0.05 $m^2$ in 40 ml of pure water. The conductivity is preferably not less than 0.005 S/m, more preferably not less than 0.01 S/m.

The conductivity is preferably not greater than 2 S/m from the practical point of view, since to increase the conductivity further than that the use of a large amount of the cationic substance is inevitable. Variation of electric resistance of the recording paper under environmental changes increases when two much cationic substance is used, and, depending on the environment of use, the transferability for electrophotographic recording may be adversely affected.

The conductivity is measured at 1 second after immersing a piece of the recording paper in pure water in the invention, because the time after ink has been applied onto a surface of paper before a highly permeable ink permeates completely into the paper is several seconds or less. The inventors of the invention determined the timing after immersing paper in water for measuring the conductivity to be 1 second for the following reasons.

There are a series of processes after the ink has been applied on the surface of the paper and before the ink completely permeates into the paper comprising (1) a first step of prompt dissociation of cationic substances on the surface of the paper into ions, and (2) a second step of colloidal aggregation and precipitation of the cationic substances and colorants in the ink by either: an insolubilizing reaction by forming complexes between cationic groups on the surface of the dissociated cationic substance molecules, and the colorant contained in the ink; or a neutralization reaction between functional groups of the surface of the colorant contained in the ink and cationic groups on the surface of the dissociated cationic substance molecules. The image quality in ink-jet printing can be improved by making the time to completion of these two steps be as short a period of time as possible.

Mobility of ions in water is in the order of $10^{-3}$ to $10^{-4}$ cm/s. Accordingly, a time period of about 1 second is necessary before the colorant contained in the ink migrates the distance of several micro meters, that is the size of voids on the surface of the recording paper, and arrives at the cationic group covered molecule surfaces of the cationic substances present on the surface of the paper. With ink having a small surface tension, as is used for high speed printing, the time after applying the ink on the surface of the paper required before the ink completely permeates into the paper is about 1 second. Therefore, a surface treatment agent, contained on the surface of the paper, must be dissociated into activated cationic groups almost at the same time as the ink is applied onto the surface of the paper.

The inventors of the invention found that, as an index for comprehending the ion dissociation rate of cationic substances present on the surface of the recording paper due to the mechanism described above, that conductivity should be measured at one second after a piece of the recording paper had been immersed into water While details of the cationic substance used in the invention are described below, the substance used essentially has high solubility and high ion dissociation ability.

The reason thereof is that, when a non-dissociating cationic substance having high solubility is used, the counter-ions responsible for increasing conductivity are not released into the ink by dissociation of the cationic substance thereby step (1) described above fails to occur. Also, when a highly soluble cationic substance with low dissociation ability is used, the time required for completing steps (1) and (2) above increases (and high conductivity is not obtained).

The cationic substances trap anionic substances, such as anionic colorants contained in ink, when ink is applied onto the surface of the paper, and image quality can be improved by a reaction (aggregation or insolubilization) between the cationic substances and the anionic substances. Consequently, the method for measuring conductivity used in the invention may be considered to be a particularly useful index for evaluating image printing using ink-jet inks containing anionic colorants.

Another method for improving the image quality in ink-jet printing, by focussing on the cationic equivalent of the cationic substance, rather than the conductivity used in the invention, may also be considered. However, the method of focussing on the cationic equivalence of the cationic substance, rather than the conductivity, is not adequate for the reasons described below.

The cationic equivalent of cationic substances (cationic polymers) is usually measured by a colloid titration method. While this method have been widely used since it was proposed in 1964, the principle thereof is based on formation of complexes by momentary ionic association of polyanions and polycations. However, the cationic equivalent obtained by this method is only measured in a very dilute solution in which cations are dissociated to the maximum extent.

However it can be assumed that, when ink is applied onto a surface of recording paper containing a cationic substance, the solution is extremely highly concentrated.

Accordingly it can be assumed that the actual cationic equivalent, when a cationic substance is dissociate as ink is applied onto a surface of recording paper, is far less when compared with the cationic equivalent measured by the colloid titration method. Accordingly, the inventors of the invention consider the index of the colloid titration method to be deficient in objective validity, when cationic equivalent measurements are used for improving the ink-jet image quality on recording paper.

Various constituent materials of the recording paper of the invention, and methods for producing the same will be described hereinafter.

—Base Paper—

Next, the base paper used for the recording paper of the invention will be described.

The base paper used for the recording paper of the invention contains pulp fibers and filler as main components.

Examples of pulp fibers include chemical pulp. Specific preferable examples include hardwood bleached draft pulp, hardwood unbleached kraft pulp, softwood bleached kraft pulp, softwood unbleached kraft pulp, hardwood bleached sulfite pulp, hardwood unbleached sulfite pulp, softwood bleached sulfite pulp, softwood unbleached sulfite pulp and the like, as well as pulp produced by chemically treating raw fibers from wood, cotton, hemp, bast and the like.

Other examples of pulps include: ground wood pulp, produced through mechanical treatment from timber or wood chips; chemi-mechanical pulp, produced through mechanical treatment of timber or wood chips that have been preliminarily impregnated with a chemical agent; and, thermo-mechanical pulp, produced by softening timber or wood chips in a steam digester, followed by use of a refiner to achieve a pulp state. Another examples include chemi-thermo mechanical pulp having a high yield. These virgin pulps may be singly used or, as appropriate, mixed with recycled pulp.

In particular virgin pulp is preferably subjected using a bleaching treatment using chlorine dioxide without the use of chlorine gas (Elemental Chlorine Free; ECF bleaching method) or a bleaching treatment mainly using ozone/hydrogen peroxide without using any chlorine containing compound (Totally Chlorine Free; TCF bleaching method).

Furthermore, for the raw materials of recycle pulp may be used; non-printed waste paper having grades of best white, special white, medium white and off white and the like obtained as off-cuts, broke, and trim-off generated in bookbinding factories, printing factories, converting factories and the like; recycled wood-free paper such as wood-free coated paper, wood-free paper and the like on which printing or copying has been performed; recycled paper printed thereon with aqueous ink, oil-based ink or pencil; recycled newspapers, including leaflets which have been printed on medium quality paper, medium quality coated paper, wood-free paper, wood-free coated paper, and the like; and waste papers including medium quality paper, medium quality coated paper, ground wood papers and the like.

In cases where recycle pulp is used for the base paper in the invention, the raw material for the waste paper is preferably subjected to an ozone bleaching treatment and/or a hydrogen peroxide bleaching treatment. In order to obtain recording paper exhibiting high brightness, it is preferable that in a recycled pulp the mixing-proportion of pulp obtained by the above bleaching treatments is within the range from 50 percent by weight to 100 percent by weight. In addition, from the viewpoint of recycling natural resources, it is more preferable that a mixing proportion in the waste paper pulp is within the range from 70 percent by weight to 100 percent by weight.

Ozone treatments have a function of breaking down fluorescent dyes and the like which generally are contained in wood-free paper. Hydrogen peroxide treatments have a function of preventing yellowing caused by alkalis used in deinking. Combined treatment using both bleaching systems not only facilitates the removal of ink from waste paper, but also the brightness of the treated pulp is further enhanced. Moreover, through breaking down and removing residual chlorine-containing compounds in pulp, these treatments are very effective in reducing the organic halide content of waste paper produced from chlorine-bleached pulp.

Further, in addition to the pulp fibers of the base paper used for the invention is added filler in order to adjust opacity; brightness and surface quality. In cases where a decrease in halogen content in the recording paper is desired, it is preferable to use a halogen free filler.

Examples of fillers include: inorganic pigments such as calcium carbonate heavy, calcium carbonate light, chalk, kaolin, calcinated clay, talc, calcium sulfate, barium sulfate, titanium dioxide, zinc oxide, zinc sulfide, zinc carbonate, aluminum silicate, calcium silicate, magnesium silicate, synthetic silica, aluminum hydroxide, alumina, sericite, white carbon, saponite, calcium montmorillonite, sodium montmorillonite, bentonite and the like; and organic pigments such as acrylic type plastic pigment, polyethylene, chitosan particles, cellulose particles, polyamino acid particles, urea resin and the like.

Also, in cases where recycled pulp is incorporated in the base paper, the ash content in the raw waste paper must be estimated in advance and the amounts of additives adjusted accordingly.

Although the mixing proportion of the filler is not particularly restricted, the mixing proportion is preferably in a range of between 1 and 80 parts by weight relative to pulp fiber of 100 parts by weight, and more preferably between 1 and 50 parts by weight.

In making pulp fiber to obtain the base paper, it is preferable to adjust the fiber orientation ratio of the base paper to within in a range of 1.0 to 1.55, more preferably to within in a range of 1.0 to 1.45, and still more preferably to within in a range of 1.0 to 1.35. If the ratio is within the range of 1.0 to 1.55 it is possible to reduce curling of the recording paper after the paper is printed using an ink-jet printing method.

Fiber orientation ratio refers to a fiber orientation ratio measured by using ultrasonic transmission speed method, and indicates a value obtained by dividing the ultrasonic transmission speed in the MD (the direction of progression in the paper machine—machine direction) by the ultrasonic transmission speed in the CD (the direction perpendicular to the machine direction—cross machine direction). Fiber orientation ratio is expressed by the following equation (1).

fiber orientation ratio ($T/Y$ ratio) of the base paper=$MD$ direction ultrasonic transmission speed/$CD$ direction ultrasonic transmission speed  Equation (1)

More specifically, the required fiber orientation ratio, using the ultrasonic transmission speed method, can be measured using, for example, a Sonic Sheet Tester (manufactured by Nomura Shoji Co., Ltd.).

—Treatment Solution—

The recording paper of the invention can be produced by applying a treatment solution containing a cationic substance and water-soluble polymer onto the surface of the recording paper as described previously. Examples of cationic substances suitable for the invention include multi-valent cationic polymers (an organic polymer cation of valency more than two), metal salts and the like.

Examples of multi-valent cationic polymers include copolymers of hydrophilic monomer component, having amino groups or quaternary ammonium groups, with hydrophobic monomer component, and salts thereof. Other components may be copolymerized, if necessary. The copolymer may be a random polymer, a graft polymer a block polymer, or the like.

Examples of the hydrophobic monomer components include styrene, styrene derivatives, vinyl toluene, vinyl toluene derivatives, vinyl naphthalene, vinyl naphthalene derivatives, butadiene, butadiene derivatives, isoprene, isoprene derivatives, ethylene, ethylene derivatives, propylene, propylene derivatives, alkyl ester of acrylic acid and alkyl ester of methacrylic acid. Preferable hydrophobic monomers among them are styrene, styrene derivatives, alkyl acrylate and alkyl methacrylate. The number of carbon atoms in the alkyl group contained in the hydrophobic monomer is preferably in the range of 1 to 10, more preferably in the range of 1 to 6.

Examples of other components include acrylamide, acrylamide derivatives, dimethylaminoethyl methacrylate, ethoxyethyl methacrylate, butoxyethyl methacrylate, ethoxytriethylene methacrylate, vinyl pyrrolidone, vinyl pyridine; polyoxyethylene-containing components such as alkyl ether, methoxypolyethyleneglycol methacrylate, polyethyleneglycol methacrylate; hydroxyl groups containing components such as hydroxymethyl methacrylate, hydroxyethyl methacrylate and vinyl alcohol.

Examples of the hydrophilic monomers having a primary, secondary or tertiary amino group or quaternary ammonium group include N,N-dimethylaminoethyl methacrylamide, N,N-dimethylaminoethyl acrylamide, N,N-dimethyl acrylamide, N,N-dimethyl methacrylamide, N,N-dimethylaminopropyl acrylamide and dimethylaminopropyl methacrylamide, and compounds in which the amino groups of these nitrogen-containing compounds are converted into quaternary ammonium groups.

Methyl chloride, methyl iodide, dimethyl sulfate, benzyl chloride and epichlorohydrin, and the like can be used for converting the amino group of the nitrogen-containing compound into the quaternary ammonium group.

Organic polymers which include in their structures primary, secondary or tertiary amine salts or quaternary ammonium salts may be used as multi-valent cationic polymers. As ammonium salt compounds the following examples are included: dodecyltrimethylammonium chloride, dodecylbenzyltrimethyl ammonium chloride, dodecyldimethylbenzyl ammonium chloride, stearyl trimethylammonium chloride, benzyltributyl ammonium chloride, benzarconium chloride and cetyldimethyl ammonium chloride.

Examples of an amine salt include ethylene oxide adduct of higher alkylamine such as dihydroxyethyl stearylamine; pyridium salt compounds such as cetylpyridium chloride and cetylpyridium bromide; and imidazoline cationic compounds such as 2-heptadecenyl hydroxyethyl imidazoline and the like. Alternatively, a so-called cationic surfactant may also be used.

Metal salts may be used as the cationic substance in addition to the examples of multi-valent cationic polymers given above. For example, it is known that the image quality is improved by treating the surface of the paper with metal salts containing magnesium, calcium or aluminum (for example see JP-A No. 61-74880).

While any known metal salt may be basically used in the invention, metal ions of valency two or more are preferably used. At least one of calcium, magnesium, strontium, barium and radium is preferably used as the metal ion of valency two or more, and at least one of calcium and magnesium is more preferably used.

These metal cations have a small molecular weight and they are readily eluted into the ink applied to the surface of the recording paper. In addition, these metal cations have a short lifetime of hydrated ions. Thus, a colorant which is generally an anionic substance can be promptly insolubilized and/or aggregated with these metal cations. In particular, since a highly permeable ink is used in an ink-jet printer for high speed printing in order to enhance dryability of the ink, the image quality cannot be improved unless the colorant contained in the ink can be promptly insolubilized and/or aggregated.

The "lifetime of hydrated ions" means a speed of exchange of hydration water, coordinated to the metal ion, when the metal ions are dissolved in water and form a hydrated ions by coordinating with water molecules ("Intermolecular and Surface Forces", 2nd edition, Israelachvili, Jacob, N.) the disclosure of which is incorporated by reference herein.

When the lifetime of hydrated ion is long the metal ion remains in a hydrated configuration during the time period from application of the ink onto the surface of the recording paper and permeation of the ink into the recording paper. Since in this case the metal ion cannot sufficiently display the function necessary for insolubilizing and trapping colorants the image quality cannot be improved.

From the above view point, the lifetime of the hydrated ion of the metal ion of the metal salt is preferably not longer than $10^{-3}$ seconds, more preferably not longer than $10^{-5}$ seconds, and the shorter the lifetime of the hydrated ion the more preferable it is. Examples of metal ions satisfying such conditions include, for example, $Li^+$ (lifetime of the hydrated ion=$10^{-9}$ to $10^{-8}$ seconds), $K^+$ (lifetime of the hydrated ion=$10^{-9}$ seconds), $Ca^{2+}$ (lifetime of the hydrated ion=$10^{-8}$ seconds) and $Mg^{2+}$ (lifetime of the hydrated ion=$10^{-6}$ to $10^{-5}$ seconds).

Since an aluminum ion is trivalent, it has a large effect in an ink using a pigment for aggregating and insolubilizing the pigment and/or polymer colloid. And in an ink using a dye it has a significant effect for insolubilizing the colorant. However, since an aluminum ion has a lifetime of the hydrated ion of as long as between $10^{-1}$ to 1 second, improvement of the image quality cannot be fully obtained when a highly permeable ink is used. Accordingly, in the invention when metal salts containing an aluminum ion are used as the cationic substance, they are preferably used together with metal salts containing metal ions having a short lifetime of hydrated ions, as described above.

Examples of the water-soluble polymer include cellulose derivatives such as carboxymethyl cellulose, hydroxyethyl cellulose and cation-modified cellulose; PVA and its derivatives such as curdlan, polyvinyl alcohol and cation-modified polyvinyl alcohol; starch derivatives such as cationic starch, oxidized starch, enzyme-processed starch, anionic starch and hydrophobic group-introduced starch; and highly hygroscopic resins such as polyacrylic acid.

While various materials other than the cationic substance and water-soluble polymer may be added, as required, to the treatment solution used for surface treatment of a base paper when producing the recording paper of the invention, it is particularly preferable that the treatment solution does not, as described above, contain any substantial quantity of pigment.

—Production Method of Recording Paper and its Properties—

The production method of recording paper and its properties according to the invention will be described below.

While the method for applying a treatment solution containing the cationic substance and water-soluble polymer is not particularly restricted, it is usually preferable to use a method in which the treatment solution is used as a coating solution (size-press liquid) for applying size-press processing to the surface of the base paper.

The coating solution can applied on the surface of base paper by a conventionally used coating units using a size press, shim size, gate roll, roll coater, bar coater, air knife coater, rod blade coater and blade coater. A base paper coated with the coating solution containing the cationic substance and water-soluble polymer can be dried in a drying step to obtain the final recording paper of the invention.

When the surface of base paper is treated by coating the cationic substance and water-soluble polymer, the treatment amount of each component is preferably in the range of 0.1 to 5 g/m$^2$ in terms of solid content remaining, more preferably in the range of 0.5 to 3 g/m$^2$.

When the treatment amount (as converted into solid fraction) of each component is less than 0.1 g/m$^2$, the amount of cations per unit area in the ink application portion of the surface of the recording paper becomes so small that there is a deterioration of image quality, particularly a decrease of image density, worsening of feathering, ICB and color reproducibility may result. However when the treatment amount (as converted into solid content) of each component exceeds 5 g/m$^2$, the texture of so-called plain paper may be impaired. Accordingly, the total treatment amount (as converted into solid fraction) of the cationic substance and water-soluble polymer applied on the surface of base paper is preferably in the range of 0.2 to 10 g/m$^2$.

The degree of sizing of the recording paper of the invention can be adjusted to a desired level simply by selecting the appropriate amount and type of the binder. However, a surface sizing agent may be used as well when sizing degree cannot be sufficiently controlled only by selecting the amount and type of the binder.

Examples of surface sizing agents that can be used include rosin sizing agents, synthetic sizing agents, petroleum resin sizing agents, neutral sizing agents, starch, and polyvinyl alcohol.

In a slurry preparation stage in the paper-making process, the degree of size may be adjusted in advance by mixing in an internal sizing agent. It is preferable to use a halogen-free internal sizing agent or surface sizing agent if a reduction of halogen content in the recording paper is desired. More specifically, rosin sizing agents, synthetic sizing agents, petroleum resin sizing agents, neutral sizing agents and the like can be used.

The sizing agent may be used with the fixing agent of the pulp fiber. In this case, aluminum sulfate, a cationized starch or the like can be used as the fixing agent. It is preferable to use a neutral sizing agent from the standpoint of enhancing the preservability of the recording paper. The degree of sizing can be adjusted by the amount of the sizing agent added.

The Stockigt sizing degree of the recording paper used for the invention is preferably 10 to 60 seconds, and more preferably 15 to 30 seconds. If the Stockigt sizing degree is less than 10 seconds the ability of the recording paper to be practically used in ink-jet printing is impaired because the degree of feathering becomes so bad that fine characters become indiscernible and printed bar codes become unreadable.

On the other hand, if the corrected Stockigt sizing degree exceeds 60 seconds, inter-color bleeding occurs and color image quality becomes poor because ink penetration becomes retarded. In addition, the drying characteristics of the ink may become inferior, and the marks may be generated on the back of the paper when high-speed printing.

The Stockigt sizing degree in the invention means the Stockigt sizing degree measured in accordance with JIS-P-8122:1976, the disclosure of which is incorporated herein by reference. This is undertaken in a standard environment (23° C. and 50% relative humidity) as specified in JIS-P-8111: 1998, the disclosure of which is incorporated herein by reference.

The recording paper of the invention can also be used in order to form an image by an electrophotographic printing method besides that of printing by the ink-jet printing method. In this case, the recording paper preferably has a smoothness of 20 to 100 seconds, and more preferably 70 to 100 seconds, from the standpoint of raising toner transferability and improving granularity. If the smoothness is less than 20 seconds, granularity may becomes inferior. On the other hand, a paper having a smoothness exceeding 100 seconds is not desirable as the recording paper because, in order to obtain high smoothness, a high-pressure press is employed to paper in a wet state when the paper is manufactured. As a result, the opacity of the recording paper may be reduced, or curling which occurs after printing in ink-jet printing may increase. The smoothness used in the invention means a value measured in accordance with JIS-P-8119: 1998, the disclosure of which is incorporated herein by reference.

The recording paper of the invention preferably has a formation index of at least 20, and more preferably at least 30, from the standpoint of improving image quality in electrophotographic recording by reducing cloudy mottles. If the formation index is less than 20, image quality may be impaired by mottles because the penetration of toner into the paper becomes non-uniform when toner is adhered by thermal fusion in electrophotographic recording.

The term "formation index" as used herein means a value obtained by measurement using a 3D Sheet Analyzer (M/K950) manufactured by M/K Systems, Inc. (MKS Corp.), in which the opening of the analyzer is set to a diameter of 1.5 mm, and with a micro formation tester (MFT).

That is, the formation index is obtained by attaching a sample of the recording paper onto a rotatable drum in the 3D Sheet Analyzer with a light source disposed on the drum axis and a photodetector disposed outside the drum responsive to the light source, rotating and measuring, as differences in light amounts, local differences in basis weight in the sample.

The target area of the measurement in this case is set by the diameter of the aperture attached to the portion of the photodetector at which light enters. The differences in light amount (deviations) are then amplified, subjected to A/D conversion, and classified into 64 optically measured classes of basis weight. 1,000,000 pieces of data are taken per scan and histogram frequencies for the data are obtained. The maximum frequency (peak value) of the histogram is divided by the number of classes having a frequency of 100 or more corresponding to the 64 classes, divisions of basis weights. Thereafter the value is divided by 100. The value obtained in this procedure is defined as the formation index. The higher the formation index is, the better the texture is.

When using the recording paper of the invention as a recording medium corresponding to not only the ink-jet printing method but also to the electrophotographic printing method, the heat transfer method, it is preferable to mix an electronically conductive agent to adjust the surface electric resistivity of the recording paper. However, in order to reduce the halogen content in the recording paper, it is preferable to use an electronically conductive agent which does not contain a halogen.

As examples of electronically conductive agents the following can be used: inorganic electrolytes such as sodium sulfate, sodium carbonate, lithium carbonate, sodium metasilicate, sodium tripolyphosphate and sodium hexametaphosphate; anionic surfactants such as sulfonic acid salts, sulfate ester salts, carboxylate salts and orthophosphates; cationic surfactants; nonionic surfactants and ampholytic surfactants such as polyethylene glycol, glycerin and sorbitol; and polymer electrolytes can be used.

For controlling permeation of the treatment solution into the base paper in the process of coating the treatment solution containing the cationic substance and water-soluble polymer onto a surface of the base paper, the air permeability of the base paper just before application of the treatment solution is adjusted at 10 to 30 seconds by subjecting it to calendering or the like. This is because the treatment solution can be suppressed from permeating into the base paper by increasing the air permeability of the base paper.

In the process of applying the treatment solution on a surface of base paper by keeping the treatment solution near the surface of the recording paper when the ink is applied onto the surface of the recording paper a larger amount of the cationic substances can be promptly dissociated into ions, before the ink starts to permeate into the recording paper, Consequently, conductivity should be adjusted to be not lower than 0.002 S/m.

However, the ink is inhibited from permeating in ink-jet printing when air permeability of base paper is too high, thereby deteriorating the inter-color bleeding and dryability. Accordingly, it is preferable to control air permeability of base paper according to the limits stated above.

Another method for controlling the treatment solution from permeating into the base paper, is to dry the base paper after the paper making process, without applying a size press process (a process for applying the treatment solution (coating solution) onto the surface of base paper). The size press process can then be applied to the dried base paper. This method is also effective for adjusting conductivity to be not less than 0.002 S/m. A further method is to adjust the viscosity of the coating solution.

It is preferable to control the viscosity of the coating solution to 10 to 50 mPa·s at 60° C. in order to suppress permeation of the coating solution into the base paper and for facilitating application of the coating solution. By controlling both the viscosity of the coating solution and air permeability of the base paper the coating solution can be made to stay near the surface of the base paper.

A recording paper capable of further improving the image quality in ink-jet printing can be produced by, as well as making the coated solution (treatment solution) stay near the surface of the recording paper, selecting a material (cationic substance) that is able to readily increase conductivity.

Surface electric resistivity of the recording paper of the invention at least on the surface at the side to be printed (printing surface) is preferably in the range of $1.0\times10^{9}$ to $1.0\times10^{11}\Omega$, more preferably in the range of $5.0\times10^{9}$ to $7.0\times10^{10}\Omega$, and further preferably in the range of $5.0\times10^{9}$ to $2.0\times10^{10}\Omega$, as measured by the method according to JIS K6911, the disclosure of which is incorporated by reference herein, after keeping the recording paper in a standard environment (a temperature of 23° C. and a relative humidity of 50% RH) prescribed in JIS P8111:1998 for 8 hours or longer.

The printing surface denotes the surface of the recording paper which contains the cationic substance and water-soluble polymer.

The volume electric resistivity of the recording paper of the invention is preferably in the range of $1.0\times10^{10}$ to $1.0\times10^{12}$ Ωcm, more preferably in the range of $1.3\times10^{10}$ to $1.6\times10^{11}$ Ωcm, and further preferably $1.3\times10^{10}$ to $4.3\times10^{10}$ Ωcm, as measured by the method according to JIS K6911, after keeping the recording paper in a standard environment (a temperature of 23° C. and a relative humidity of 50% RH) prescribed in JIS P8111:1998 for 8 hour or longer.

When surface electric resistivity and volume electric resistivity do not satisfy the ranges above, transferability in electrophotography may be deteriorated by changes in the environment.

The cationic substance used in the recording paper according to the invention is a factor for determining conductivity related to the image quality of ink-jet printing, and surface electric resistivity and volume electric resistivity related to transfer ability in electrophotography. However, in a more strict sense, the former is determined by the properties of the cationic substance itself, such as ion dissociation rate of the cationic substance and lifetime of the hydrated ions, and by the production conditions of the recording paper such as air permeability of base paper and the viscosity of the treatment solution. The latter is basically determined by the amount of the cationic substance applied on the surface of the recording paper.

Accordingly, since the conductivity can be readily controlled substantially independently from the control of the surface electric resistivity and volume electric resistivity, the recording paper of the invention makes it easy to obtain a recording paper which is able to be highly adaptable to both ink-jet printing and electrophotography.

<An Ink-Jet Image Recording Method>

Next, the ink-jet recording method of the invention will be described below. The image is formed by applying a droplet of ink ejected from a recording head onto the surface of the recording paper in the ink-jet recording method of the invention. The ink is applied at least onto the surface of the recording paper which contains the cationic substance and water-soluble polymer. The ink used is not particularly restricted and any known ink can be used, however an ink containing water and colorant is preferable.

Herein, colorants used are not only dyes but also hydrophobic pigments used together with a pigment dispersing agent containing a hydrophilic group in order to be dispersed in the ink, and self dispersing pigments to be described below can be used. A known water-soluble organic solvent besides water can be used as a solvent, and a surfactant or the like and various additives or the like can be further contained as appropriate.

An ink containing a colorant having the hydrophilicity described above is suitably used. Examples of ink sets used when multi-color printing include an ink set provided with at least black ink, cyanogen ink, magenta ink and yellow ink, and it is preferable to mix water, a water-soluble organic solvent, a colorant and a surfactant or the like further to prepare these inks.

Each ink in the ink set contains water, a water-soluble organic solvent, a colorant, a surfactant, a water-soluble polymer or the like. When the pigment is used as a colorant, a self-dispersing pigment (pigment which can be dispersed in water containing no pigment dispersing agent) is used in many cases. The surface of the self-dispersing pigment contains a lot of functional groups (water-soluble groups) which enables the dissolution to water. Thereby, the self-dispersing pigment can be stably dispersed even if a pigment dispersing agent does not exist in the ink.

In the invention, a self-dispersing pigment means a pigment which satisfies the following requirements.

First, the pigment is dispersed in water such that the pigment density become 5% by weight based on water of 95% by weight, using dispersion apparatus such as an ultrasonic homogenizer, a nanomizer, a microfluidizer and a ball mill, without using a pigment dispersing agent. Next, a dispersion liquid in which the pigment is dispersed is put into a glass bottle, and is left for 8 hours. Herein, the self-dispersing pigment in the invention means that the pigment density of the supernatant fluid of the dispersing liquid after left 8 hours is 98% or more of the initial density.

At this time, a method for measuring the density of the pigment is not particularly limited, and a method for drying a sample to measure solids content, a method for diluting to suitable density to request from transmissivity may be used. The density of the pigment may be measured by the other method for requesting the density of the pigment correctly.

The "self-dispersing pigment" can be produced by subjecting the usual hydrophobic pigment to a surface modifying treatment such as an acid/base treatment, a coupling agent treatment, a polymer graft treatment, a plasma treatment, an oxidation/reduction treatment. Since the pigment (self-dispersing pigment) subjected to the surface treatment contains more water-soluble groups for demonstrating the solubility to water than the usual pigment, the pigment can be dispersed in the ink even if a pigment dispersing agent is not used.

Although the hydrophobic pigment to which the surface treatment is performed is not particularly limited, Specific examples thereof include the following pigments.

Examples of the black pigments include Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080 and Raven 1060 (all of the black pigments described above are manufactured by Columbian Chemicals Company); Regal 400R, Regal 330R, Regal 660R, Mogul L, Black Pearls L, Monarch 700, Monarch 800, Monarch 880, Monarch 900, Monarch 1000, Monarch 1100, Monarch 1300 and Monarch 1400 (all of the black pigments described above are manufactured by Cabot Corporation); Color Black FW1, Color Black FW2, Color Black FW2V, Color Black 18, Color Black FW 200, Color Black S150, Color Black S160, Color Black S170, Pritex 35, Pritex U, Pritex V, Printex 140U, Printex 140V, Special Black 6, Special Black 5, Special Black 4A and Special Black 4 (all of the black pigments described above are manufactured by Deggusa Co.); No. 25, No. 33, No. 40, No. 47, No. 52, No. 900, No. 2300, MCF-88, MA 600, MA7, MA8 and MA100 (all of the black pigments described above are manufactured by Mitsubishi Chemical Co., Ltd.). However, examples of the black pigments are not limited thereto.

Specific examples of the cyan pigment include C. I. Pigment Blue-1, C. I. Pigment Blue-2, C. I. Pigment Blue-3, C. I. Pigment Blue-15, C. I. Pigment Blue-15:1, C. I. Pigment Blue-15:2, C. I. Pigment Blue-15:3, C. I. Pigment Blue-15:4, C. I. Pigment Blue-15:34, C. I. Pigment Blue-16, C. I. Pigment Blue-22, and C. I. Pigment Blue-60. However, examples of the cyan pigment are not limited thereto.

Specific examples of the magenta pigment include C. I. Pigment Red 5, C. I. Pigment Red 7, C. I. Pigment Red 12, C. I. Pigment Red 48, C. I. Pigment Red 48:1, C. I. Pigment Red 57, C. I. Pigment Red 112, C. I. Pigment Red 122, C. I. Pigment Red 123, C. I. Pigment Red 146, C. I. Pigment Red 168, C. I. Pigment Red 184, and C. I. Pigment Red 202. However, examples of the magenta pigment are not limited thereto.

Specific examples of the yellow pigment include C. I. Pigment Yellow-1, C. I. Pigment Yellow-2, C. I. Pigment Yellow-3, C. I. Pigment Yellow-12, C. I. Pigment Yellow-13, C. I. Pigment Yellow-14, C. I. Pigment Yellow-16, C. I. Pigment Yellow-17, C. I. Pigment Yellow-73, C. I. Pigment Yellow-74, C. I. Pigment Yellow-75, C. I. Pigment Yellow-83, C. I. Pigment Yellow-93, C. I. Pigment Yellow-95, C. I. Pigment Yellow-97, C. I. Pigment Yellow-98, C. I. Pigment yellow-114, C. I. Pigment yellow-128, C. I. Pigment Yellow-129, Pigment Yellow-138, C. I. Pigment Yellow-151, C. I. Pigment Yellow-154, and C.I. Pigment Yellow-180. However, examples of the yellow pigment are not limited thereto.

In the invention, magnetic substance particulates such as magnetite and ferrite, and titanium black or the like may be used.

As "the self-dispersing pigment", a commercial item can be used as it is besides pigment which performed surface modification processing to the above hydrophobic pigment. Examples of the commercially available pigments include cab-o-jet 200, cab-o-jet 250, cab-o-jet 260, cab-o-jet 270, cab-o-jet-300, IJX-444, JX-164, IJX-253, IJX-266 and IJX-273 (manufactured by Cabot Corporation); Microjet black CW-1 and Microjet black CW-2 (manufactured by Orient Chemical Industries, Ltd.), however, the invention will be not limited thereto.

Although water-soluble groups contained in "the self-dispersible pigment" may be any of groups having nonionic properties, cationic properties and anionic properties, particularly desirable are those of a sulfonic group, a carboxylic group, a hydroxyl group and a phosphoric group. In the case of the sulphonic group, the carboxylic acid and the phosphoric acid, the acids may be used in a state of a free acid, however, these acids may form a salt. When the salt is formed, it is preferable that a counter ion of the acid is generally Li, Na, K, $NH_4$ or organic amine.

The content of the pigment contained in the ink preferably ranges from 0.1 to 15% by weight, more preferably in the range from 0.5 to 10% by weight, and still more preferably in the range from 1.0 to 8.0% by weight. When the content of the pigment is more than 10% by weight, clogging may be easily generated on the tip of a nozzle of a recording head. When the content of the pigment is less than 0.1% by weight, sufficient image density may not be obtained.

A refined material is preferably used for the pigment. For example, impurities can be removed by water washing, and adsorption methods such as an ultra-filtration-membrane method, an ion exchange treatment, activated carbon and zeolite. Although a refining process is not particularly limited, the density of the inorganic substance which originates in the impurities of the colorant in the ink is preferably 500 ppm or less, and more preferably 300 ppm or less.

When using a water-soluble colorant, i.e., dye, as the colorant, a known colorant or a colorant compounded newly can be used. Although any of water-soluble dye and dispersing dye are sufficient as the dye, of these, a direct, dye or an acid dye can obtain bright color are preferable. Specific Examples include the following.

Examples of black dyes include C. I. Direct Black-2, -4, -9, -11, -17, -19, -22, -32, -80, -151, -154, -168, -171, -194, -195; C. I. Food Black-1, -2; C. I. Acid Black-1, -2, -7, -16, -24, -26, -28, -31, -48, -52, -63, -107, -112, -118, -119, -121, -156, -172, -194, -208.

Examples of blue dyes include C. I. Direct blue-1, -2, -6, -8, -22, -34, -70, -71, -76, -78, -86, -112, -142, -165, -199, -200, -201, -202, -203, -207, -218, -236, -287, -307; C. I. Acid blue-1, -7, -9, -15, -22, -23, -27, -29, -40, -43, -55, -59, -62, -78, -80, -81, -83, -90, -102, -104, -111, -185, -249, -254; C. I. Disperse Violet-33, C. I. Disperse Blue-14, -26, -56, -60, -73, -87, -128, -143, -154, -165, -165:1, -176, -183, -185, -201, 214, -224, -257, -287, -354, -365, -368, C. I. Disperse Green-6:1, -9.

Examples of red dyes include C. I. Direct red-1, -2, -4, -8, -9, -11, -13, -15, -20, -28, -31, -33, -37, -39, -51, -59; -62, -63, -73, -75, -80, -81, -83, -87, -90, -94, -95, -99, -101, -110, -189, -227; C. I. acid red-1, -4, -8, -13, -14, -15, -18, -21, -26, -35, -37, -52, -110, -144, -180, -249, -257, -289; C. I. Disperse Orange-13, -29, -31:1, -33, -49, -54, -66, -73, -119, -163; C. I. Disperse Red-1, -4, -11, -17, -19, -54, -60, -72, -73, -86, -92, -93, -126, -127, -135, -145, -154, -164, -167:1, -177, -181, -207, -239, -240, -258, -278, -283, -311, -343, -348, -356, -362.

Examples of yellow dyes include C. I. Direct-Yellow-1, -2, -4, -8, -11, -12, -26, -27, -28, -33, -34, -41, -44, -48, -58, -86, -87, -88, -132, -135, -142, -144, -173; C. I. Acid-Yellow-1, -3, -4, -7, -11, -12, -13, -14, -18, -19, -23, -25, -34, -38, -41, -42, -44, -53, -55, -61, -71, -76, -78, -79, -122; C. I. Disperse Yellow-3, -5, -7, -8, -42, -54, -64, -79, -82, -83, -93, -100, -119, -122, -126, -160, -184:1, -186, -198, -204, -224. These dyes may be used either alone or in combination of two or more kinds thereof.

Cationic dyes can be used besides a direct color or acid dye. Examples of the cationic dyes include C. I. basic yellow-1, -11, -13, -19, -25, -33, -36; C. I. basic red-1, -2, -9, -12, -13, -38, -39, -92; C. I. basic blue-1, -3, -5, -9, -19, -24, -25, -26, -28.

The content of the dye contained in the ink preferably ranges from 0.1 to 10% by weight, more preferably in the range from 0.5 to 8% by weight, and still more preferably in the range from 0.8 to 6% by weight. When the content of the dye is more than 10% by weight, clogging may be easily generated on the tip of a nozzle of a recording head in the ink-jet printing method. When the content of the dye is less than 0.1% by weight, sufficient image density may not be obtained.

A known organic solvent can be used for the water-soluble organic solvent. Examples of the water-soluble organic solvent polyalcohols such as ethylene glycol, diethylene glycol, propylene glycol, butylene glycol, triethylene glycol, 1,5-pentanediol, 1,2,6-hexanetriol, glycerin and the like; polyalcohol-ethers such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether and the like; nitrogen containing solvents such as pyrrolidone, N-methyl-2-pyrrolidone, cyclohexylpyrrolidone, triethanol amine and the like; alcohols such as ethanol, isopropyl alcohol, butyl alcohol, benzyl alcohol and the like;

sulfur containing solvents such as thiodiethanol, thiodiglycerol, sulfolane, dimethylsulfoxide and the like; and propylene carbonate, ethylene carbonate.

The surfactant is added to the ink in order to adjust the surface tension of the ink. As a surfactant, nonionic surfactants and anionic surfactants which do not readily affect the dispersing state of the pigment are preferable.

As the nonionic surfactant, there may be used: polyoxyethylenenonyl phenyl ether, polyoxyethyleneoctyl phenyl ether, polyoxyethylenedodecyl phenyl ether, polyoxyethylenealkyl ether, polyoxyethylene fatty ester, sorbitan fatty ester, polyoxyethylenesorbitan fatty ester, fatty alkylolamide, acetylene alcohol ethyleneoxide adduct, polyethylene glycol polypropylene glycol block copolymer, polyoxyethylene ether of glycerin ester, polyoxyethylene ether of sorbitol ester and the like.

As the anionic surfactant, there may be used: an alkylbenzene sulfonate, an alkylphenyl sulfonate, an alkylnaphthalene sulfonate, a higher fatty acid salt, an alkyl sulfate of a higher fatty acid ester, a higher alkylsulfosuccinate and the like.

Ampholytic surfactants may be used, and as the ampholytic surfactant, there may be used: betain, sulfobetaine, sulfate betain, imidazoline and the like. In addition to the above, there are exemplified: silicone type surfactants such as a polyoxyethylene adduct of polysiloxane; fluorine containing surfactants such as an oxyethyleneperfluoroalkyl ether and the like; biosurfactants such as Spiculisporic acid, rhamnolipid, lysolecithin and the like When a polymer substance is added to the ink, it is necessary to select the polymer in consideration of affinity with the colorant, cohesiveness of the polymer substance itself or the like, on the basis of acid value or the like. A preferable example of the polymer substance selected in the view of the properties of the polymer is an anionic polymer compound containing carboxylic acid groups. This is because the carboxylic acid group has a small dissociation constant.

Although preferable examples of the anionic polymers are shown, the invention is not limited thereof.

Examples of the anionic polymers include alginic acid salt, acrylic acid salt, carboxymethylcellulose sodium or the like. Of those, a copolymer obtained from a monomer having an alpha, beta-ethylene unsaturated group constituting a hydrophilic part and a monomer having an alpha, beta-ethylene unsaturated group constituting a hydrophobic part is preferable.

It is more preferable that the monomer constituting the hydrophilic part is at least one kind selected from the group consisting of acrylic acid, methacrylic acid and anhydrous maleic acid and maleic acid, and the monomer constituting, the hydrophobic part is at least one kind selected from the group consisting of alkyl of styrene acrylic acid, alkyl of styrene methacrylic acid, arylester and alkylarylester.

The molecular weight of the water-soluble polymer such as the anionic polymer is preferably in a range of 3000 to 15000 in the weight average molecular weight due to Gel Permeation Chromatography (GPC) method, more preferably in a range of 4000 to 10000, and still more preferably in a range of 4000 to 7000.

As the monomer having an alpha, beta-ethylenically unsaturated group constituting the hydrophilic moiety, there is not any specific limitation. As examples of the monomer, there may be used: monomers having a carboxyl group. Specific examples thereof include acrylic acid, methacrylic acid, crotonic acid, itaconic acid, itaconic acid, monoester, maleic acid, maleic acid monoester, fumaric acid, fumaric acid monoester. Of these, particularly, acrylic acid, methacrylic acid, maleic acid and anhydrous maleic are preferred, and these may be used singly or in combination of two or more kinds thereof.

As the monomer having an alpha, beta-ethylenically unsaturated group constituting the hydrophobic moiety there is not any specific limitation. As examples of the monomer, there may be used: styrene, styrene derivatives such as alpha-methylstyrene and vinyltoluene and the like; vinylnaphthalene, vinylnaphthalene derivative, acrylic acid alkyl ester, methacrylic acid alkyl ester, crotonic acid all ester, itaconic acid dialkyl ester, maleic acid dialkyl ester and the like. Particularly, styrene, methacrylic acid alkyl ester, acrylic acid alkyl ester, aryl ester and alkyl aryl ester are preferred. These may be used singly or in combination of two or more kinds thereof.

The water-soluble polymer described above may be used singly or in combination of two or more kinds thereof. Although the addition amount thereof cannot simply be specified since the amount differs greatly depending on the colorant used, the amount is generally in a range of 0.1 to 100% by weight, preferably in a range of 1 to 70% by weight, and more preferably in a range of 3 to 50% by weight relative to the weight of the colorant.

For the ink used for the invention, it is also useful to add methyl cellulose, ethyl cellulose and derivatives thereof, glycerins, poly glycerin and polyethylene oxide thereof, a polypropylene oxide additive, or a polysaccharide, and derivatives thereof as a viscosity adjuster. Specific examples of the viscosity adjusters include glucose, fructose, Mannit, D-sorbitol, dextran, xanesangum, curdlan, cycloamylose, maltitol and derivatives thereof.

The viscosity of the ink used for the ink-jet printing method of the invention is preferably in the range from 1.5 to 5.0 mPa·s, and more preferably in the range from 1.5 to 4.0 mPa·s. For measuring the viscosity of the ink, a rotating viscosity meter Leo Matt 115 (manufactured by Contraves) is used, and the viscosity of the ink is measured at 23° C. and at a shear speed of 1400 $s^{-1}$.

The pH of the ink may be adjusted to the desired value, and examples of substances for adjusting pH include potassium hydrate, sodium hydrate, lithium hydroxide, ammonium hydroxide, triethanolamine, diethanolamine, ethanol amine, 2-amino-2-methyl-1-propanol, ammonia, ammonium phosphate, potassium phosphate, sodium phosphate, lithium phosphate, sodium sulfate, acetic acid salt, lactic acid salt, benzoic acid salt, acetic acid, hydrochloric acid, nitric acid, sulfuric acid, phosphoric acid, propionic acid, and P-toluenesulfonic acid. Or, common pH buffer, for example, good buffers may be used. The pH of the ink is preferably in a range of 3 to 11, and particularly preferably 4.5 to 9.5.

It is preferable that the surface tension of the ink is in a range of 20 to 40 mN/m. If the surface tension is less than 20 mN/m, the ink penetration to the recording paper is too fast, and since ink permeates to the inside of the recording paper, the reduction of the image density and the bleeding of characters may be generated. Since the ink penetration to the recording paper becomes retarded and drying characteristics get worse when the surface tension is larger than 40 mN/m. Thereby it may be difficult to use with high-speed printing.

The surface tension of the ink is more preferably in a range of 25 to 37 mN/m, and is still more preferably in a range of 28 to 35 mN/m. The surface tension of the ink is measured at 23° C. under 50% RH using a Wilhelmy type surface tensiometer.

Examples of methods for adjusting the surface tension of the ink include a method for adding at least one kind selected from the group consisting of the surfactant, polyhydric alcohols and monohydric alcohols to the ink. When adding the surfactant to the ink, at least one kind of a nonionic surfactant and an anionic surfactant is preferably used.

The sum of the content of the compound in the ink, it is preferably in a range of 0.01 to 3.0% by weight, more preferably 0.03 to 2.0% by weight, and still more preferably 0.05 to 1.5% by weight. Particularly, when the surfactant is independently used, it is preferable that the content is in a range of 0.3 to 1.5% by weight.

When monohydric alcohols including an ether bond are used, at least one kind of compound selected from the following general formula (2) is used. The sum of the content of the compound represented by the general formula (2) in the ink is preferably in a range of 1 to 5% by weight, more preferably 2 to 10% by weight and still more preferably 3 to 8% by weight.

$$CnH_{2n+1}(CH_2CRHO)_mH \qquad \text{Formula (2)}$$

wherein, in Formula (2), n represents the integer of 1 to 6, m represents the integer of 1 to 3, and R represents a hydrogen atom or represents an alkyl group having the number of carbon atoms of 1 to 5.

When the monohydric alcohols except being represented by the general formula (2) are contained, ethanol, propanol and butanol or the like are preferably used. The sum of the content in the ink is preferably is in a range of 1.0 to 8.0% by weight, and more preferable 2.0 to 5.0% by weight. The surfactant, polyhydric alcohols and monohydric alcohol described above may be simultaneously contained.

When the pigment is used for the ink in the ink-jet record method of the invention, for example, the ink described above can be obtained by adding a pigment of a prescribed amount to a water solution, sufficiently sating the resultant mixture, dispersing the resultant mixture using a disperser, excluding coarse particles by centrifugal separation or the like, adding and mixing a prescribed solvent and additive or the like to the resultant mixture while stirring, and filtering the resultant mixture.

In this case, the concentrated dispersing element of the pigment is previously produced, and a method for diluting at the time of ink manufacture can also be used. The grinding step of the pigment may be provided before the dispersing step. Or, after mixing a prescribed water-soluble organic solvent, water and a pigment dispersing agent, the pigment may be added, and the resultant mixture may be dispersed using the disperser.

Commercially available dispersing machines may be used. There are exemplified: a colloid mill, a flow jet mill, a slasher mill, a high speed disperser, a ball mill, an attriter, a sand mill, a sand grinder, an ultrafine mill, an eiger motor mill, a dyno mill, a pearl mill, an agitator mill, a cobol mill, a three-roll mill, a two-roll mill, an extruder, a kneader, a micro-fluidizer, a laboratory homogenizer, an ultrasonic homogenizer and the like, which may be used singly or in combination thereof. It is preferable to employ a dispersing method without using a dispersing medium in order to prevent contamination of inorganic impurities, preferably employing a micro-fluidizer, an ultrasonic homogenizer and the like.

Ink using the self-dispersible pigment as the colorant is produced, for example, as follows. The self-dispersible pigment obtained by surface modification treatment of the hydrophobic pigment is added to water and, after thoroughly mixing, the pigment is dispersed, if necessary, using the same dispersion devices and in the same way as described above. Subsequently, coarse particles contained in this solution are removed by centrifugation from the solution obtained after the stirring. Finally, the desired solvent and additives and the like are added to the solution from which the coarse particles have been removed, and the ink is obtained by stirring, mixing and filtration.

When the recording paper of the invention is printed by the ink-jet printing method using ink described above, the ink drop amount ejected from a nozzle of recording head is preferable in a range of 1 to 20 pl, and still more preferably 3 to 18 pl.

When the ink drop amount is in a range of 1 to 20 pl, and preferably 3 to 18 pl in a printing due to a so called thermal ink-jet printing method which makes thermal energy act, forms ink droplets and prints, it is preferable that the dispersing particle diameter of the pigment in the ink using the pigment is in a range of 20 to 120 nm of the volume mean particle size, and the number of coarse particles of whose the volume average particle diameter (dispersing particle diameter) is 500 nm or more is $5\times10^5$ or less pieces in the ink of 2 μl. If the volume mean particle size (dispersing particle diameter) is smaller than 20 nm, sufficient image density may not be obtained. If the volume mean particle size (dispersing particle diameter) is larger than 120 nm, clogging at a recording head is likely to occur, and the stable jetting performance may be unable to be secured. When the number of coarse particles of which the volume average particle diameter (dispersing particle diameter) is 500 nm or more is more than $5\times10^5$ pieces in the ink of 2 μl, the clogging at the recording head is likely to occur, and the stable jetting performance may be unable to be secured. The number of coarse particles is more preferably $3\times10^5$ or less pieces in the ink of 2 μl, and still more preferably $2\times10^5$ or less pieces.

It is preferable that the storage elastic modulus of the ink at 24° C. is in a range of $5\times10^{-4}$ to $1\times10^{-2}$ Pa. Since the ink has suitable elasticity in the range, the behavior of the ink applied to the surface of the recording paper is preferable. The storage elastic modulus of the ink is a value when measured in the low shear speed range in a range of angular velocity of 1 to 10 rad/s. The value can be easily measured, if the apparatus which can measure the viscoelasticity of the low shear speed range is used. Examples of the measurement apparatus include VE type viscoelasticity analyzer (manufactured by a VILASTIC SCIENTIFIC INC. company), and DCR viscoelasticity measuring apparatus for low viscosity (manufactured by Paar Physica).

If a known ink-jet machine uses an ink-jet printing method, the ink-jet printing method in the invention can provide good printing quality. The ink-jet printing method of the invention can be applied to an ink-jet printing machine which has a function heating the recording paper and the ink at the temperature of 50° C. to 200° C. and promoting the absorption and fixing of the ink, and is equipped with a heating unit for heating the recording paper or the like during printing or before and after printing.

Next, an example of an ink-jet printing machine suitable for conducting the ink-jet record method in the invention will be described. The example is a so called multi-pass type, and the recording head scans on the recording paper two or more times to form an image.

A method for ejecting the ink from a nozzle is a so called thermal ink-jet printing method for foaming the ink in the nozzle by carrying out energization heating to a heater provided in the nozzle, and ejecting the ink with the pressure. In another method, a pressure-sensitive element is deformed physically by energizing to the pressure-sensitive element, and the ink is ejected from the nozzle using the power caused by the deformation. This method using a piezoelectric element for a pressure-sensitive element is typical. In the ink-jet printing machine used in the ink-jet record method of the invention, the method for ejecting the ink from the nozzle may be said which method is not limited to these methods. These aspects are the same as the following.

Nozzles are arranged in the orthogonal direction with the main scanning direction of a head carriage. Specifically, the nozzles can be arranged in one row at a density of 800 per inch. The number and density of the nozzles are arbitrary. Not only can the nozzles can be arranged in one single row, but the nozzles can also be arranged in a staggered formation.

Ink tanks storing the ink used for the invention for each color of cyanogen, magenta, yellow and black are integrally attached to recording heads on the upper part of the recording head. The inks stored in the ink tanks are supplied to the recording head corresponding to the colors. The ink tank and the recording head may be integrally formed. However, the invention is not limited to this method, and for example, the ink tank may be separately arranged from the recording head, and the ink may be supplied to the recording head from the ink tank through an ink supply tube.

A signal cable is connected to each of these recording heads. This signal cable transmits the image information after treated by an image processing part to each recording head for each color of cyanogen, magenta, yellow and black.

The recording head is fixed to the head carriage. The head carriage is freely slidably attached in the main scanning direction along with a guide rod and a carriage guide. The head carriage can be reciprocatingly driven along the main scanning direction through a timing belt by rotating a driving motor to predetermined timing.

A platen is fixed to the lower part of the head carriage, and the recording paper used for the invention is conveyed on the platen at a predetermined timing by a conveyance roller for sending paper. For example, the platen comprises a plastic molding material or the like.

Thus, the recording paper of the invention can be printed by using the ink to be described. The example of the multi-pass method provided with five recording heads has been described. However, when applying the ink-jet printing method of the invention to the ink-jet printing machine of a multi-pass method, it is not limited to this example. For example, the ink-jet printing machine may have two recording heads of a black head and a color head. Among these, in the color head, the nozzle may be divided in the row direction, and a predetermined color may be assigned to each range divided.

When a high-speed printing of 10 ppm or more (10 sheet/minute or more) which is equal to a laser printer used in office is performed, the scanning rate of the recording head is 25 or more cm/second. However, in the high-speed scan of the recording head, the interval by which the ink of two different colors is printed becomes narrow, and the inter-color bleeding (ICB) is easily generated. In order to enhance the ink drying, it is necessary to use ink having low surface tension. The use of the ink having low surface tension causes the generation of feathering and the reduction of image density. Since the ink having low surface tension has the high penetration to a recording paper, the printed character and image are transparent from the back, and can be easily seen. Thereby, the both side printability is ruined.

However, when the high-speed printing is performed using a conventional recording paper, the generation of the feathering and the reduction of the image density are caused. Since ink having low surface tension has high penetration to a recording paper, the printed character and image are transparent from the back, and can be easily seen through. Thereby, the double-sided printability is ruined. However, if the recording paper of the invention is used, the generation of the problem can be prevented.

The scanning rate of the recording head means the movement speed of the recording head when the recording head prints by scanning on the recording paper two or more times in a so called multi-pass method in which the recording head runs perpendicularly to the ejected direction of the recording paper.

Next, the second example of an ink-jet printing machine suitable for conducting the ink-jet record method in the invention will be described. The example is called one path method. In the one path method, a recording head has a width almost equal to that of the recording paper, and when the recording paper passes the lower part of the recording head, printing is concluded. Since high productivity is acquired compared with the multi-pass method, the high-speed printing more than that of a laser recording method can be performed.

Since the one path method does not need to scan the recording head two or more times like a multi-pass method, high-speed printing can be easily performed at the recording paper conveying speed of the 60 mm/second or more (speed at which the recording paper passes the lower part of the recording head) corresponding to 10 ppm or more. On the other hand, since division printing cannot be performed, it is necessary to eject a lot of ink from the recording head at once. Therefore, in a conventional one path type ink-jet printing method not using the recording paper of the invention, feathering and inter-color bleeding occur and the reduction of image density, the reduction of the double sided printability, the inferior dryability are caused.

However, a high proportion of the cationic substance coated on the surface of the paper is promptly eluted upon contact of the recording paper of the invention with the ink in the ink-jet printing method of the invention, even when the scanning speed of the recording head in the multi-path method is not less than 250 mm/second in high speed printing, or when the convey speed of the recording paper is not less than 60 mm/second in high speed printing while the recording had is fixed in the one-path method.

Accordingly, insolubilization of the colorant and anionic polymer added to the ink, and colloidal aggregation and precipitation are accelerated to enable a high quality image to be obtained without generating feathering and inter-color bleeding while dryability is enhanced without impairing the ability for printing on both surfaces.

The scanning rate of the recording head is preferably 500 mm/second or more from a viewpoint of "the productivity which is equal to a laser printer", and more preferably 1000 mm/second or more. The conveying speed of the recording paper is preferably 100 mm/second or more, and more preferably 210 mm/second or more.

In any of these methods, in order to apply ink sufficient at the time of high-speed printing to form a solid image to a recording paper, the maximum quantity of ink to be ejected is 6 $ml/m^2$ or more. However, if the ink-jet printing method of the invention is used in high-speed printing carried out in the maximum quantity of ink, an image not having feathering and inter-color bleeding can be obtained, and both side printing can be performed in the same manner as in a laser printer.

The maximum quantity of ink to be ejected is preferably is in a range of 7 to 20 $ml/m^2$, more preferably 10 to 18 $ml/m^2$.

As described above, according to the ink-jet printing method of the invention, in the ink-jet printing machine performing a high-speed printing of 10 ppm or more, the printing which provides sufficient image density can be performed without occurring poor images such as inter-color bleeding and feathering.

<An Electrophotographic Image Recording Method>

The electrophotographic image recording method according to the invention using the recording paper of the invention includes: uniformly charging a surface of an electrostatic latent image support; exposing the surface of the electrostatic latent image support to light, to thereby form an electrostatic latent image; developing the electrostatic latent image formed on the surface of the electrostatic latent image support, using an electrostatic image developer, to form a toner image; transferring the toner image onto a surface of the recording paper; and fixing the toner image on the surface of a recording paper. The toner image is transferred and fixed on the surface containing at least a cationic substance and water-soluble polymer.

The electrophotographic image recording method according to the invention affords similar high quality images to those of conventional electrophotographic methods.

The image forming machine used for the image recording method by electrophotography according to the invention is not particularly restricted so long as it is an electrophotographic method comprising charging, exposing, developing, transferring and fixing. For example, when four color toners of cyan, magenta, yellow and black are used, a color image forming machine using a four-cycle development method for forming a toner image by sequentially applying the developer containing respective colors on one photosensitive member (latent image support). Similarly a color image forming machine comprising four development units (a so-called tandem machine) corresponding to respective colors may also be used.

The toner used for forming the image is not particularly restricted and any know toner may be used. For example a spherical toner, having a small particle size distribution may be used for obtaining highly precise images, or a toner containing a low melting point binder resin capable of low temperature fixing may be used for saving energy.

EXAMPLES

While the present invention is described in detail hereinafter with reference to examples, the invention is by no means restricted to these examples.

Example 1

A hardwood kraft pulp is bleached by an Elemental Chlorine Free (ECF) multi-step bleaching process including oxygen bleaching, alkali extraction and vapour-phase chlorine dioxide processing steps. The pulp obtained is beaten to a freeness of 450 ml. A base paper is made by using 100 parts by mass of the bleached and beaten pulp, 3 parts by mass of bentonite filler, 3 parts by mass of calcium carbonate light filler and 0.1 parts by mass of alkyl ketene dimer (AKD) internal sizing agent.

Then, the base paper obtained is size pressed using as a surface sizing agent a coating solution (viscosity 10.0 mPa·s at 60° C.) containing 87 parts by mass of water, 6 parts by mass, calcium thiocyanate tetrahydrate, 6 parts by mass of calcium carbonate hexahydrate, 6 parts by mass of oxidized starch (trade name Ace A, manufactured by Oji Corn Starch Co.) and 1 part by mass of sodium sulfate. In this way a recording paper is obtained with a coating of calcium thiocyanate 1.0 g/m$^2$ (coated amount (the same meaning as treatment amount described above, the same hereinafter)) and oxidized starch (coated amount: 1.0 g/m$^2$) on the surface of the paper.

The Stockigt sizing degree of the base paper of the recording paper before size pressing is measured and air permeability is measured according to JISP8117:1998, the disclosure of which is incorporated by reference herein. Surface electric resistivity, volume electric resistivity, Stockigt sizing degree, formation index and smoothness of the recording paper sheer after coating are also measured according to the methods as described previously.

Conductivity is measure as follows. A piece, with a size of 0.05 m$^2$, is cut from the recording paper obtained. Also 40 ml of pure water (23° C.) is sampled in a glass tube, and conductivity of pure water is measured to confirm the conductivity to be below detectable limits, and the sample tube filled with pure water is placed in an ultrasonic cleaner. Then, the piece of recording paper is folded into ⅓ of its original size and wrapped and fixed around an electrode of a conductivity meter, and this electrode wrapped with the recording paper is immersed into the water in the sample tube. Conductivity is measured 1 second after immersing the electrode in the water. The conductivity is 0.004 S/m. The conductivity of each of the recording papers which follow is also measured in the same way.

Conductivity meter MPC 227 (trade name, manufactured by Mettler Toledo Co.) is used for the measurement of conductivity. The detection limit of this conductivity meter is 0.0001 S/m. For the pure water, water with a specific resistivity value of 18 MΩcm is prepared by combination of ion-exchange resin, UV sterilizer and reverse osmosis membrane using a Milli-Q system (trade name, manufactured by Japan Millipore Co.).

Example 2

A hardwood kraft pulp is bleached by a TCF multistage bleaching process including a xylanase-treatment, alkali extraction, hydrogen peroxide-treatment and ozone-treatment steps. The pulp obtained is beaten to a freeness of 450 ml. A base paper is made using 100 parts by mass of the bleached and beaten pulp, adding 3 parts by mass of kaolin filler, 6 parts by mass of calcium carbonate light filler and, 0.2 parts by mass of alkenyl succinic anhydride (ASA) inner sizing agent.

Then, the paper obtained is size pressed using as a surface sizing agent a coating solution (viscosity 25 mPa·s at 60° C.) containing 98 parts by mass of water, 1 part by mass of polyacrylic acid, and 1 part by mass of a quaternary ammonium salt (trade name HP200A manufactured by Senka Co.—cation equivalent 4.3 meq/g). In this way a recording paper is obtained with a coating of polyacrylic acid (coated amount: 0.5 g/m$^2$) and quaternary ammonium salt (coated amount: 0.5 g/m$^2$) coated on the surface of the paper. The conductivity for this recording paper is 0.0025 S/m.

Example 3

A softwood mechanical pulp is bleached with hydrosulfite, and is beaten to a freeness of 450 ml. A base paper is made using 100 parts by mass of the pulp, 8 parts by mass of calcium carbonate light filler and 0.02 parts by mass of alkenyl succinic anhydride (ASA) internal sizing agent.

The base paper thus obtained is size pressed using as a surface sizing agent a coating solution (viscosity 20 mPa·s at 60° C.) containing 94 parts by mass of water, 1 part by mass of cation-modified polyvinyl alcohol (trade name Gohsefimer K210, manufactured by Nippon Synthetic Chemical Industry Co.) and 5 parts by mass of calcium bromide. In this way, a recording paper is obtained with a coating of calcium bromide (coated amount: 1.0 g/m$^2$) and cation-modified polyvinyl alcohol (coated amount: 0.2 g/m$^2$) on the surface of the paper. Conductivity for this recording paper is 0.0145 S/m.

Comparative Example 1

A hardwood kraft pulp is bleached by the same TCF process as in Example 2 followed by beating. A base paper is made using 100 parts by mass of the bleached and beaten pulp, 3 parts by mass of calcium carbonate light filler, 3 parts by weight of saponite filler, and 2 parts by weight of neutral rosin sizing agent. The base paper thus obtained is size pressed using as a surface sizing agent a coating solution (viscosity 10.0 mPa·s at 60° C.) of 90 parts by mass of water, 5 parts by mass of oxidized starch (trade name Ace A, manufactured by Oji Corn Starch Co.) and 5 parts by mass of aluminum sulfate. In this way, a recording paper having a coating of oxidized starch (coated amount: 1.0 g/m$^2$) and aluminum sulfate (coated amount: 1.0 g/m$^2$) on the surface of the paper. Conductivity of this recording paper is 0.0006 S/m.

Comparative Example 2

A hardwood sulfite pulp is bleached by the same ECF process as in Example 2 followed by beating. A base paper is made using 100 parts by mass of bleached and beaten pulp, 15 parts by mass of calcium carbonate light filler and 0.1 parts by mass of alkenyl succinic anhydride (ASA) inner sizing agent.

Then, the base paper obtained is is size pressed using as a surface sizing agent a coating solution (viscosity 70 mPa·s at 60° C.) containing 80 parts by mass of water, 5 parts by mass of oxidized starch (trade name Ace B, manufactured by Oji Corn Starch Co.) and 15 parts by mass of polyethyleneimine (cation equivalent: 9.8 meq/g). In this way a recording paper is obtained with a coating of polyethyleneimine (coated amount: 2.4 g/m$^2$) and oxidized starch (coated amount: 0.8 g/m$^2$) on the surface of the paper. Conductivity for this recording paper is 0.0004 S/m.

Comparative Example 3

A softwood sulfite pulp is bleached by the same ECF process as in Example 2 followed by beating. A base paper is made using 100 parts by mass of the bleached and beaten pulp, 20 parts by mass of kaolin filler and 0.05 parts by mass of alkenyl ketene dimer (AKD) inner sizing agent.

The base paper thus obtained is size pressed using as a surface sizing agent a coating solution (viscosity 7.8 mPa·s at 60° C.) containing 86 parts by mass of water, 4 parts by mass of oxidized starch (trade name Ace A, manufactured by Oji Corn Starch Co.) and 10 parts by mass of aluminum nitrate. In this way, a recording paper is obtained with a coating of aluminum nitrate (coated amount: 1.6 g/m$^2$ and oxidized starch (coated amount: 0.7 g/m$^2$) on the surface of the paper. The making of this recording paper is carried out by referring to recording paper 7 in the Examples described in JP-A No. 61-74880. The conductivity for this recording paper is 0.0001 S/m.

Comparative Example 4

Super White SW201 (Manufactured by Canon Co.) as a commercially available ink-jet paper is used as a comparative example. The conductivity for this recording paper is 0.0003 S/m.

Comparative Example 5

A softwood sulfite pulp is bleached by the same ECF process as in Example 2 followed by beating. A base paper is made using 100 parts by mass of the bleached and beaten pulp, 20 parts by mass of kaolin filler and 0.05 parts by mass of alkenyl ketene dimer (AKD) internal sizing agent.

The base paper thus is size pressed using as a surface sizing agent a coating solution (viscosity 7.8 mPa·s at 60° C.) containing 86 parts by mass of water, 4 parts by mass of oxidized starch (trade name Ace A, manufactured by Oji Corn Starch Co.) and 10 parts by mass of beryllium sulfate. In this way, a recording paper is obtained having a coating of beryllium sulfate (coated amount: 1.5 g/m$^2$ and oxidized starch (coated amount: 0.7 g/m$^2$ on the surface of the paper. The conductivity for this recording paper is 0.00002 S/m.

—Measurement of Recording Paper Properties—

The properties of the recording paper obtained are measured under the following conditions. The Stockigt sizing degree is measure in accordance with JIS-P-8122:1976 in a standard environment (temperature 23° C., relative humidity 50% relative humidity). The surface and volume electric resistivity are measured in the standard environment according to JIS-K-6911.

The smoothness is measured in accordance with JIS-P-8119:1998 using an Oken type digital display type air permeability smoothness measuring instrument type EY (trade name, manufactured by Asahi Seiko Co.). The formation index is measured using a 3D sheet analyzer M/K950 manufactured by M/K Systems, Inc. (MKS Corp.) in which the aperture of the analyzer is set to a diameter of 1.5 mm, and using a micro-formation tester (MFT).

As the thermal ink-jet printing machine for the printing tests, a Work Centre B900 (trade name, manufactured by Fuji Xerox) is used, The test is performed in an environment of 23° C. and 55% relative humidity (RH) using cartridges filled with a black pigment ink (surface tension: 38 mN/m) and an yellow dye ink (surface tension: 28 mN/m) mounted on the printing machine.

The recording heads have 256 nozzles at a nozzle pitch of 800 dpi. The recording paper is printed at a ink drop amount of about 15 pl; the maximum quantity of ink to be ejected is about 15 ml/m$^2$; the printing mode—one side batch printing; and scanning rate of the recording head of about 1100 mm/second. Various evaluations are described below.

—Image Optical Density—

The image optical density of a solid patch part one day after printing is measured using a X-Rite 369 (trade name, manufactured by X-Rite Co.). The criteria for evaluation are as follows, and "A" and "B" indicates acceptable levels.

A: 1.5 or more

B: no less than 1.0 and less than 1.5

C: less than 1.0

—Inter-Color Bleeding (ICB) Evaluation—

The black ink and yellow ink are printed as 2 cm×2 cm square patches so as to come into contact with each other. Inter-color bleeding is evaluated by visually inspecting the color mixing at the portions where the patches contact one another, naked eye 10 persons, and was evaluated according to the following criteria. "A" and "B" indicate acceptable levels.

A: no color mixing

B: slight color mixing, but not enough to present problems

C: color mixing enough to present problems

—Feathering Evaluation—

8 point font sized characters are printed with inks containing dye and an inks containing pigment. The feathering evaluation is by visual observation according to the following criteria. "A" and "B" indicate acceptable levels.

A: no bleeding observed in kanji and hiragana characters

B: bleeding observed in only very limited parts of kanji and hiragana characters C: Bleeding observed in kanji and hiragana characters—not a suitable quality for actual use.

—Evaluation of Ink Drying Time—

The ink drying time is evaluated by observing whether or not image portions are transferred to paper pushed against an image portion (solid patch portion) immediately after printing. In this case, the time period at which the ability to transfer ink to the pushed paper disapears is measured. This time period is evaluated according to the following criteria. "A" and "B" are acceptable levels.

A: less than 2 seconds

B: 2 to 5 seconds

C: 5 to 10 seconds

D: 10 seconds or more

—See-Through Evaluation—

The optical density on the back surface behind a solid patch portion after one day from printing is measured using a X-Rite 369 (trade name, manufactured by X-Rite Co.). The criteria for evaluation are as follows, and "A" and "B" indicate acceptable levels.

A: less than 0.05

B: 0.05 or more and less than 0.15

C: 0.15 or more

As an electrographic recorder, a DocuCentreColor 400CP (trade name, manufactured by Fuji Xerox Co.) is used, and evaluation of image density and transferability is carried out as described below.

—Evaluation of Image Density—

100% solid images of magenta are printed in a size of 5 cm×5 cm square using recording paper in the Examples and Comparative Examples after moistening by placing them in an environment of 28° C. and 85% RH for 8 hours or longer. The optical density of the image is measured using X-Rite 369 (trade name, manufactured by X-Rite Co.). The criteria for evaluation are as follows, and "A" and "B" indicate acceptable levels.

A: 1.5 or more

B: no less than 1.1 and less than 1.5

C: less than 1.1

—Evaluation of Transferability—

In image density evaluation, the level of generating mottled images due to defective toner transfer is observed. The criteria for evaluation are as follows, and "A" indicates an acceptable level.

A: mottling in the density of the image cannot be discerned.

B: mottling of images can be observed slightly with the naked eye.

C: The whole image is mottled.

The results of evaluations described above are shown in Tables 1 and 2.

TABLE 1

| | | Example 1 | Example 2 | Example 3 |
|---|---|---|---|---|
| Base Paper | Stockigt Sizing Degree (s) | 60 | 60 | 50 |
| | Air Permeability(s) | 10 | 20 | 30 |
| Recording Paper | Conductivity after immersing in water for 1 second(S/m) | 0.004 | 0.0025 | 0.0145 |
| | Cationic Substance | Calcium Thiocyanate (lifetime of hydrated ion: $10^{-8}$ seconds)*1 | Quaternary Ammonium Salt (cation equivalent: 4.3 meq/g) | Calcium Bromide (lifetime of hydrated ion: $10^{-8}$ seconds)*1 |
| | Coated amount (g/m$^2$) | 1 | 0.5 | 1 |
| | Type of water-soluble polymer | Oxidized Starch | Polyacrylic Acid | Cation-modified PVA |
| | Coated amount (g/m$^2$) | 1 | 0.5 | 0.2 |
| | Surface electric resistivity (Ω) | $5.0 \times 10^{10}$ | $7.0 \times 10^{10}$ | $1.5 \times 10^{11}$ |
| | Volume electric resistivity (Ωcm) | $3.0 \times 10^{11}$ | $2.2 \times 10^{11}$ | $6.5 \times 10^{11}$ |
| | Stockigt sizing degree (s) | 40 | 60 | 50 |
| | Smoothness (s) | 80 | 100 | 120 |
| | Formation Index | 30 | 20 | 40 |
| Ink-jet Method | Image Density (pigment: black) | A | B | B |
| | Image Density (dye: yellow) | B | B | B |
| | Inter-color bleeding | A | A | A |
| | Feathering (pigment: black) | A | B | A |
| | Feathering (dye: yellow) | B | A | A |
| | Drying Time | A | A | A |
| | See-through Density (pigment: black) | B | B | B |
| | See-through Density (dye: Yellow) | B | A | B |
| Electro-photographic Method | Image Density (magenta) | A | A | A |
| | Transferability | A | A | A |

[1]The lifetime of the hydrated ion is quoted from the reference "Intermolecular Force and SurfaceTension", second edition, Asakura Shoten

TABLE 2

| | | Comparative Example 1 | Comparative Example 2 | Comparative Example 3 | Comparative Example 4 (Canon Super White SW201) | Omparative Example 5 |
|---|---|---|---|---|---|---|
| Base Paper | Stockigt Sizing Degree (S) | 20 | 20 | 5 | — | 10 |
| | Air Permeability (B) | 10 | 50 | 5 | — | 10 |
| Recording Paper | Conductivity after immersing in water for 1 second (S/m) | 0.0006 | 0.0004 | 0.00001 | 0.0003 | 0.00002 |
| | Cationic Substance | Aluminum Sulfate (lifetime of hydrated ion: 1 second)*1 | Polyethyleneimine (cation equivalent 9.8 meq/g) | Aluminum Sulfate (lifetime of hydrated ion: 1 second)*1 | — | Beryllium sulfate (lifetime of hydrated ion: 0.001 to 0.01 second)*1 |
| | Coated amount (g/m$^2$) | 1 | 2.4 | 1.6 | — | 1.5 |
| | Type of water-soluble polymer | Oxidized Starch | Oxidized Starch | Oxidized Starch | — | Oxidized Starch |
| | Coated amount (g/m$^2$) | 1 | 0.8 | 0.7 | — | 0.7 |
| | Surfce electric resistivity (Ω) | $3.2 \times 10^{11}$ | $5.0 \times 10^{10}$ | $2.0 \times 10^{11}$ | $1.3 \times 10^{10}$ | $1.2 \times 10^{11}$ |
| | Volume electric resistivity (Ω · cm) | $3.5 \times 10^{11}$ | $1.0 \times 10^{10}$ | $2.0 \times 10^{11}$ | $1.0 \times 10^{10}$ | $1.5 \times 10^{11}$ |
| | Stockigt Sizing Degree (s) | 10 | 60 | 3 | 34 | 20 |
| | Smoothness (s) | 100 | 120 | 65 | 61 | 55 |
| | Formation Index | 30 | 20 | 30 | 31.8 | 30 |
| Ink-jet Method | Image Density (pigment: black) | B | C | B | B | B |
| | Image Density (dye: yellow) | B | C | B | B | B |
| | Inter-color bleeding | C | C | C | C | C |
| | Feathering (pigment: black) | C | C | C | C | C |
| | Feathering (dye: yellow) | C | C | C | C | C |
| | Drying Time | A | C | A | A | A |
| | See-through Density (pigment: black) | B | A | C | C | C |
| | See-through Density (dye: yellow) | B | B | B | B | C |
| Electro-photographic Method | Image Density (magenta) | B | B | A | B | A |
| | Transferability | A | B | A | B | A |

[1]The lifetime of the hydrated ion is quoted from the reference "Intermolecular Force and Surface Tension", second edition, Asakura Shoten Tables 1 and 2 show that when recording paper of the invention is printed by an ink-jet printing machine, there is relatively little inter-color bleeding and feathering if inks containing dye or pigment is used, compared with when recording paper of the comparative examples is used. In addition the image density is high, the speed of drying is fast and the see-through density, which is an evaluation index of aptitude for double-sided printing, is also reduced when the printing paper of the invention is used. When the recording paper of the invention is printed with an electrophotographic recorder, there is little generation of defective toner transfer, as compared with the conventional printing papers, and the recording paper of the invention, can be used in the same manner as conventional electrophotographic recording papers.

What is claimed is:

1. A recording paper comprising:

a base paper containing pulp fibers and filler as main components, said base paper further comprising calcium thiocyanate and a water-soluble polymer, wherein:

a conductivity of water is not less than 0.002 S/m as measured at 1 second after immersing a piece of the recording paper with an area of 0.05 m$^2$ in 40 ml of pure water, and the recording paper does not have a coating layer with a pigment content of more than 20% by weight.

2. The recording paper according to claim 1, wherein the conductivity of water is not less than 0.005 S/m.

3. The recording paper according to claim 1, wherein the conductivity of water is not less than 0.01 S/m.

4. The recording paper according to claim 1, wherein the recording paper is produced by applying a treatment solution containing the calcium thiocyanate comprising a calcium ion having a lifetime of a hydrated ion of not longer than $10^{-3}$ seconds and the water soluble polymer, such that the treatment amount with the calcium thiocyanate to the base paper is in the range of 0.1 to 5 g/m$^2$, in terms of solid content remaining.

5. The recording paper according to claim 1 having a surface electric resistivity in the range of $1.0\times10^{9}$ to $1.0\times10^{11}$Ω after keeping the paper for more than 8 hours in an environment with a temperature of 23° C. and a relative humidity of 50% RH, and a volume electric resistivity in the range of $1.0\times10^{10}$ to $1.0\times10^{12}$ Ωcm after keeping the paper for more than 8 hours in an environment with a temperature of 23° C. and a relative humidity of 50% RH.

6. The recording paper according to claim 4, wherein the treatment solution does not contain a substantial quantity of the pigment.

7. The recording paper according to claim 4, wherein the lifetime of the hydrated ion is not longer than $10^{-5}$ seconds.

8. The recording paper according to claim 4, wherein an air permeability of the base paper just before the treatment solution is applied thereon is 10 to 30 seconds.

9. The recording paper according to claim 4, wherein the base paper is in a substantially dry condition just before the treatment solution is applied.

10. An ink-jet image recording method for forming an image, the method comprising:

applying a droplet of ink containing a colorant and at least one kind of solvent selected from the group consisting of water and a water-soluble organic solvent to the surface of a recording paper, wherein:

the recording paper comprises:

a base paper containing pulp fibers and filler as main components, said base paper further comprising calcium thiocyanate and a water-soluble polymer, the recording paper does not have a coating layer with a pigment content of more than 20% by weight, and a conductivity of water is not less than 0.002 S/m as measured at 1 second after immersing a piece of the recording paper with an area of 0.05 $m^2$ in 40 ml of pure water.

11. The recording method according to claim 10, wherein the ink has a surface tension in the range of 20 to 40 mN/m.

12. The ink-jet image recording method for forming an image according to claim 10, wherein the recording paper is produced by applying a treatment solution containing the calcium thiocyanate comprising a calcium ion having a lifetime of a hydrated ion of not longer than $10^{-3}$ seconds and the water soluble polymer, such that the treatment amount with the calcium thiocyanate to the base paper is in the range of 0.1 to 5 $g/m^2$, in terms of solid content remaining.

13. An electrophotographic image recording method comprising:

uniformly charging a surface of an electrostatic latent image support;

exposing the surface of the electrostatic latent image support to light, to thereby form an electrostatic latent image;

developing the electrostatic latent image formed on the surface of the electrostatic latent image support, using an electrostatic image developer, to form a toner image;

transferring the toner image onto a surface of a recording paper; and fixing the toner image transferred onto the surface of the recording paper, wherein:

the recording paper comprises:

a base paper containing pulp fibers and filler as main components, said base paper further comprising calcium thiocyanate and a water-soluble polymer, the recording paper does not have a coating layer with a pigment content of more than 20% by weight, and a conductivity of water is not less than 0.002 S/m as measured at 1 second after immersing a piece of the recording paper with an area of 0.05 $m^2$ in 40 ml of pure water.

14. The electrophotographic image recording method according to claim 13, wherein the recording paper is produced by applying a treatment solution containing the calcium thiocyanate comprising a calcium ion having a lifetime of a hydrated ion of not longer than $10^{-3}$ seconds and the water soluble polymer, such that the treatment amount with the calcium thiocyanate to the base paper is in the range of 0.1 to 5 $g/m^2$, in terms of solid content remaining.

* * * * *